US009598259B2

(12) United States Patent
Fukuda

(10) Patent No.: US 9,598,259 B2
(45) Date of Patent: Mar. 21, 2017

(54) NOTEBOOK AND PROCESS FOR PRODUCTION THEREOF

(71) Applicant: YUGENGAISHA MISATOMIRAI21, Taito-ku (JP)

(72) Inventor: Manabu Fukuda, Misato (JP)

(73) Assignee: YUGENGAISHA MISATOMIRAI21, Taito-ku (JP)

( * ) Notice: Subject to any disclaimer, the term of this patent is extended or adjusted under 35 U.S.C. 154(b) by 140 days.

(21) Appl. No.: 14/491,007

(22) Filed: Sep. 19, 2014

(65) Prior Publication Data

US 2015/0091288 A1 Apr. 2, 2015

(30) Foreign Application Priority Data

Oct. 1, 2013 (JP) ..... 2013-206367

(51) Int. Cl.

| | |
|---|---|
| ***B41M 3/14*** | (2006.01) |
| ***B65H 39/10*** | (2006.01) |
| ***B42D 5/02*** | (2006.01) |
| ***B42D 15/00*** | (2006.01) |
| ***B42F 7/02*** | (2006.01) |
| ***B42F 7/04*** | (2006.01) |
| ***B42D 25/30*** | (2014.01) |
| ***B65H 45/20*** | (2006.01) |

(52) U.S. Cl.

CPC ..... *B65H 39/10* (2013.01); *B42D 5/023* (2013.01); *B42D 15/008* (2013.01); *B42D 25/30* (2014.10); *B42F 7/02* (2013.01); *B42F 7/04* (2013.01); *B65H 45/20* (2013.01); *B41M 3/14* (2013.01)

(58) Field of Classification Search

CPC ..... B65H 45/20; B65H 45/228; B41M 3/14; B42D 15/006

USPC ..... 270/21.1; 109/25; 358/3.28

See application file for complete search history.

(56) References Cited

U.S. PATENT DOCUMENTS 3,518,940 A * 7/1970 Stroud et al. ..... B41F 17/007 101/111

4,620,725 A * 11/1986 Maehashi ..... B42D 1/06 148/105

(Continued)

FOREIGN PATENT DOCUMENTS

CN 2036107 U 4/1989

CN 2182061 Y 11/1994

(Continued)

OTHER PUBLICATIONS

Office Action issued Oct. 27, 2015 in Chinese Patent Application No. 201410515581.2 (with English language translation).

*Primary Examiner* — Patrick Mackey

(74) *Attorney, Agent, or Firm* — Oblon, McClelland, Maier & Neustadt, L.L.P.

(57) ABSTRACT

A notebook including a group of a preset number of consecutive unit forms which are printed on both faces thereof and spreadably zigzag-folded is produced through a process that includes: printing on both surfaces of a continuous web by two printers each equipped with an endless belt-shaped printing plate, with intermediate inversion of the two surfaces of the web, followed by zig-zag folding and cutting and separating the printed web for each of the preset number of forms. The obtained notebook is capable of preventing falsification and missing pages by inclusion of a horizontal ruled line provided in a main data region and formed of a succession of micro characters.

13 Claims, 10 Drawing Sheets

(56) References Cited

U.S. PATENT DOCUMENTS

| | | | | | |
|---|---|---|---|---|---|
| 4,817,525 | A * | 4/1989 | Yagi | B41F 13/14 | 101/219 |
| 5,065,992 | A * | 11/1991 | Crowley | B42F 21/02 | 270/39.05 |
| 5,149,075 | A * | 9/1992 | Crowley | B65H 45/20 | 270/39.02 |
| 5,178,418 | A * | 1/1993 | Merry | B41M 3/14 | 283/73 |
| 5,279,536 | A * | 1/1994 | Abreu | B65H 45/1015 | 226/108 |
| 8,573,651 | B2 * | 11/2013 | Seki | D21H 21/42 | 281/2 |
| 9,028,929 | B2 * | 5/2015 | Sekine | C09D 11/50 | 428/29 |
| 2003/0047643 | A1 * | 3/2003 | Lamothe | G03B 1/42 | 242/615.21 |
| 2013/0220154 | A1 * | 8/2013 | Fukuda | B41F 13/10 | 101/219 |
| 2014/0021674 | A1 * | 1/2014 | Fujio | B42B 2/00 | 270/21.1 |

FOREIGN PATENT DOCUMENTS

| | | | |
|---|---|---|---|
| EP | 2 636 526 | A1 | 9/2013 |
| JP | 2011-53424 | | 3/2011 |
| JP | 2012-96490 | | 5/2012 |
| JP | 5324950 | B2 | 10/2013 |
| JP | 5342950 | | 11/2013 |

* cited by examiner

NOTEBOOK AND PROCESS FOR PRODUCTION THEREOF

TECHNICAL FIELD

The present invention relates to a high-security notebook which is prepared by zigzag folding a continuous form having prints on both sides and provided with capability of preventing falsification and missing pages, and a process for producing the notebook.

BACKGROUND ART

The present inventor developed a fundamental printing technology of using an endless belt-shaped printing plate for manufacturing an elongated strip-shaped printed continuous form by printing on an elongated continuous web form (continuous paper web). The technology of printing on a continuous form using an endless belt-shaped printing plate is applied to preparation of booklet forms for payment of a pension and insurance or a tax, a calendar, a contract, an operation manual, and books, etc.

Moreover, it is widely used also for preparation of individual or separate sheet prints requiring high quality and high security, such as a service ticket, a travel ticket, a gift certificate, a cash voucher, a stock certificate, and a debenture from a feed roll of continuous web form along with a progress of printing technology in recent years.

By the way, a notebook has been conventionally prepared by covering a plurality, e.g., 40 or 60, of inside paper sheets, with a front cover and a back cover, and by fixing or gluing the sides of the sheets to form a booklet. The inside paper sheets of a notebook are formed by printing ruled lines on each face of paper sheet. Although the ruled lines are formed as solid lines or dotted lines, the inside paper sheets of a notebook are formed of separate sheets.

In the conventional technology of printing on a continuous web form taken out from a paper feed roll using an endless belt-shaped printing plate, printing is performed on one side of a continuous form and not on both sides of the continuous form continuously. Accordingly, no technology has been developed for printing continuously on both sides of a continuous form, or for folding-up zigzag such an elongated continuous web form printed on both sides thereof to prepare a notebook.

In a conventional notebook, individual paper sheets are stacked to form a booklet of inside paper sheets, which is then covered with a front cover and a back cover. For such a notebook prepared from paper sheets, it is difficult to find an inferior product caused by possible lack, missing or damage of a portion of inside paper sheets, or to notice such a lack of page on a part of inside paper sheets.

On the other hand, the replication technology by a copying machine is developed in recent years and, in connection therewith, it is desired to develop a high-security print of which reproduction is impossible with a copying machine. Similarly, it is also expected to develop a notebook of which reproduction of contents such as characters is difficult. However, a conventional notebook is not provided with capability of preventing the falsification or omission of inside paper sheets between a front cover and a back cover, and it has not become a high-security one.

PRIOR ART DOCUMENTS

Patent Documents

[Patent document 1] JP 2012-96490 A
[Patent document 2] JP 2011-53424 A
[Patent document 3] JP 5324950 B.

SUMMARY OF THE INVENTION

The present invention has been made in consideration of the situation mentioned above, and an object of the present invention is to provide a notebook which has been prepared by folding zigzag a continuous web form printed on both surfaces thereof and is provided with capability of preventing the falsification or omission of pages to satisfy a high-security, and a process for production thereof.

Another object of the present invention is to provide a notebook which has been prepared by folding zigzag a continuous web form into a form allowing spread-reading and is therefore different in type from a conventional notebook in a form of booklet formed by firm binding of inside paper sheets.

According to the present invention, there is provided a notebook, comprising: a unit form group including a preset number of consecutive unit forms zigzag-folded and printed on both faces thereof, said unit form group having been prepared by providing a continuous web form which has been printed on both surfaces thereof including at least one surface on which the unit forms are printed, folding up zigzag the continuous web form for every unit form, cutting the continuous web form for every preset number of consecutive unit forms, and stacking the unit forms to prepare a notebook, so as to allow spread-reading of the respective unit forms, wherein each unit form has a note face, and the note face includes a main data area equipped with a plurality of printed ruled lines, a date region, and also a succession of micro characters printed on at least one part thereof.

In a preferred embodiment, the printed ruled lines in the main data area include horizontal ruled lines formed with a succession of micro characters.

The present invention also provides a notebook, wherein the group of unit forms spreadably zigzag-folded and stacked of the above-mentioned notebook are covered spreadably with a book cover including a front cover, a spine and a back cover, and is disposed spreadably, wherein the front cover and the back cover are each provided with a cover plate applied onto a back thereof so as to allow insertion of a sheet behind the cover plate from an inward position of the cover plate, a first unit form and a second unit form are held in a folded state by insertion between the back of the front cover and the cover plate, and a last unit form and a last but one unit form are held in a folded state by insertion between the back of the back cover and the cover plate.

The present invention also provides a process for producing a notebook, comprising:

successively printing a multiplicity of unit forms including ruled lines formed of a succession of micro characters by a first printer equipped with an endless belt-shaped printing plate on one surface of a continuous web form supplied from a feed roll, inverting the front and back surfaces of the continuous web form with a form inverter, printing on the other surface of the continuous web form by a second printer equipped with an endless belt-shaped printing plate to provide the continuous web form with prints on both surfaces, folding up zigzag the continuous web form for every unit form to pile up the zigzag-folded continuous web form on a stack, and cutting and separating the continuous web form for every preset number of consecutive unit forms, thereby providing a notebook including a group of the preset number of consecutive unit forms which have been printed on both faces thereof and spreadably zigzag-folded.

According to the present invention, a continuous web form which has been printed on both faces thereof is zigzag-folded for every unit form and piled up, and the zigzag-folded web form is cut and separated in a width direction for every preset number of unit forms to form a zigzag-folded notebook. The notebook is formed not of separate sheets but of respective unit forms (inside paper, successively connected with each other, so that falling-off of unit forms can be prevented and the breakage or damage of the contents can be securely confirmed in case where it occurred.

Moreover, the note face of each of the unit forms constituting the notebook is printed with a succession of micro characters (used herein to mean characters, numerals or symbols which are at most 1 point (=0.3514 mm) in size and cannot be recognized at least by observation with naked eyes to convey some meaningful data). Micro characters are collapsed when copied by using an ordinary copying machine, such as an electrophotography copying machine, so that the reproduction thereof is impossible, and the notebook is provided with a falsification prevention function to ensure a high security. A succession or row of micro characters are preferably incorporated as at least a portion of a horizontal ruled line on a note face.

Furthermore, the notebook can be read in a spread state, allows checking of data recorded thereon in a larger area at one time and is thus a new type of notebook.

EMBODIMENTS OF THE INVENTION

Hereinafter, some embodiments of the present invention will be described with reference to accompanying drawings.

First Embodiment

Figure 1:
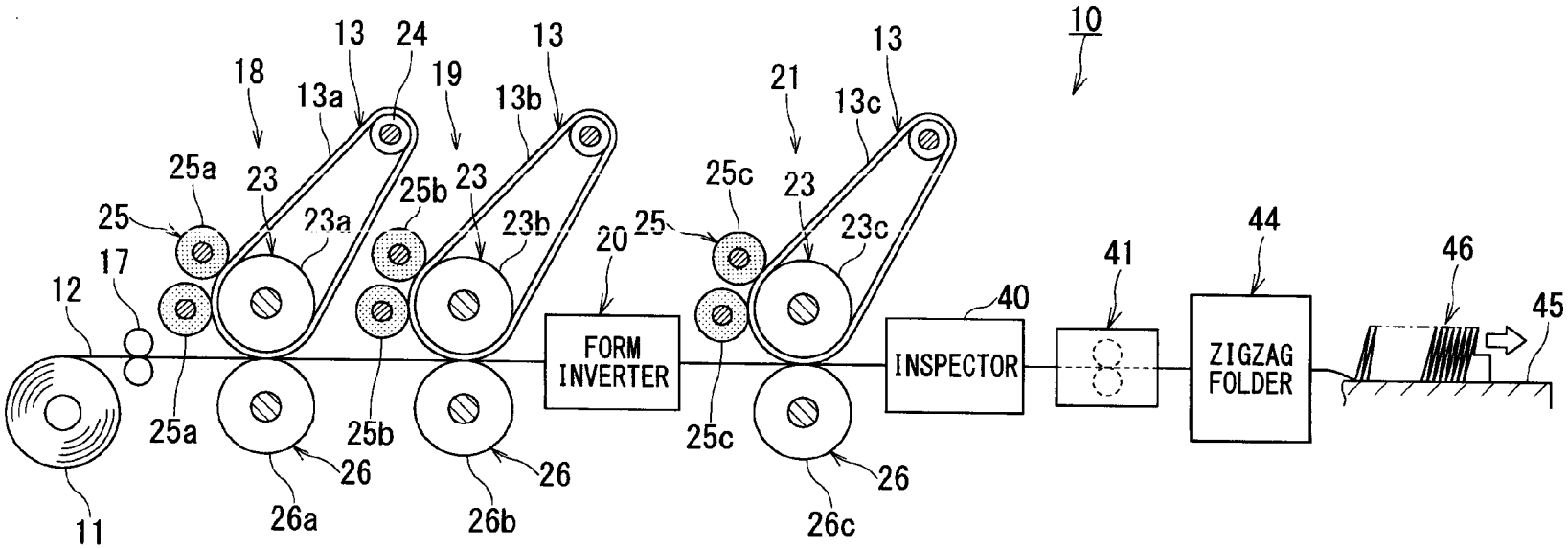
FIG. 1 is a configuration diagram for illustrating an operation principle of an embodiment of notebook manufacturing apparatus.

FIG. 1 is a configuration diagram for illustrating an operation principle of an embodiment of notebook manufacturing apparatus, whereby an elongated continuous web form (continuous paper) is successively printed on both surfaces thereof by means of a plurality of printers, that is, at least two printers, each equipped with an elongated, flexible, endless belt-shaped printing plate; and the continuous web form is zigzag-folded up to form a group of zigzag-folded unit forms.

A notebook manufacturing apparatus 10 may be referred to as a rotary press printing machine whereby an elongated continuous web form (continuous paper, rolled paper) 12 supplied from a feed roll 11 is successively printed by elongated endless belt-shaped printing plates 13.

Figure 2:
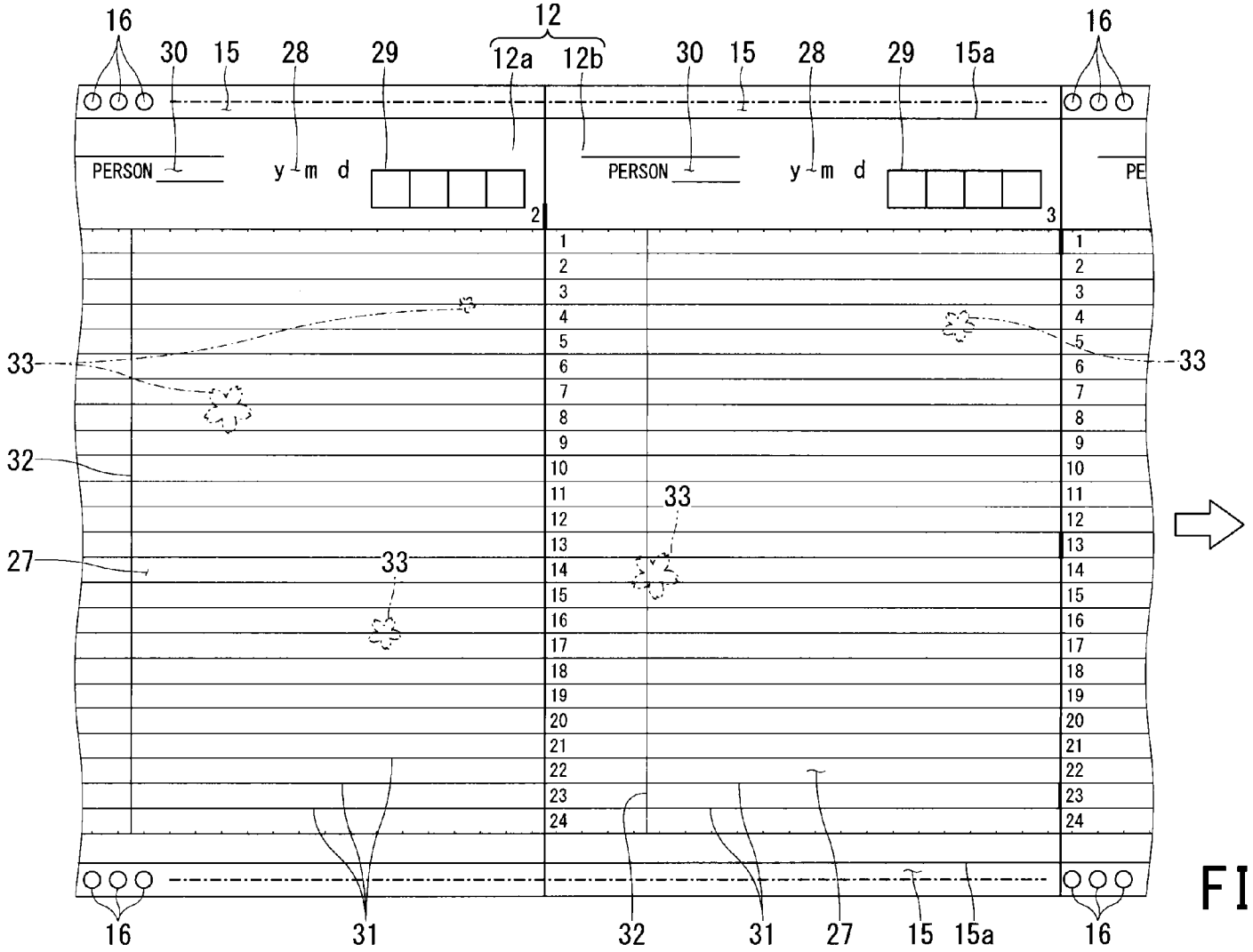
FIG. 2 is a plan view showing an intermediate printed state on a continuous web form manufactured by the above-mentioned apparatus.

As shown in FIG. 2, the continuous web form 12 fed out of the feed roll 11 is provided with punched holes 16 at an equal pitch of e.g. ½ inch intervals along marginal zones 15 on both sides by a perforation apparatus (not shown). The punched holes 16 are formed as guide holes, whereby the continuous web form 12 is exactly guided and sent in the longitudinal direction thereof. Thus, the continuous web form 12 sent out from the feed roll 11 is sent to the first printer 18 through the guide roller 17, and is suitably printed on one of its front and back surfaces, e.g. back surface, by a first printer 18. The continuous web form 12 is then sent to a second printer 19, whereby the continuous web form 12 is printed with watermarks. The continuous web form 12 printed by the second printer 19 is sent to a form inverter device 20, whereby the front and back surfaces of the web form 12 are turned upside down. The reversed continuous web form 12 is then sent to a third printer 21 for printing on the other surface, e.g., the front surface. The printers 18, 19 and 21 each have an identical structure and identical function, and are used for respectively predetermined printings.

The endless belt-shaped printing plate 13 of the printers 18, 19, and 21 is produced from a flexible elongated resinous relief printing plate disclosed in JP2011-53424A and JP2012-96490A (the disclosures of which are incorporated herein by reference). A plurality of the thus-produced resinous relief printing plates are connected one by one in a longitudinal direction, and then both longitudinal ends of the connected printing plates are connected to form an endless belt-shaped printing plate 13. The endless belt-shaped printing plates 13 are produced by connecting the resinous relief printing plates at an installation site of the respective printers 18, 19 and 21, and are twisted around the respective printers 18, 19, and 21.

The endless belt-shaped printing plates 13 are each formed of a flexible film-like resinous relief printing plate, and the respective endless belt-shaped printing plate 13 (13*a*, 13*b*, 13*c*) are each wound about a plate cylinder 23 and a guide cylinder (guide roller) 24 and are operated synchronously. More specifically, each endless belt-shaped printing plate 13 (13*a*, 13*b*, or 13*c*) may have a longitudinal and circumferential length appropriately selected from a range of several meters to several tens of meters, for example, 7 m-50 m. The endless belt-shaped printing plates 13*a*, 13*b* and 13*c* (13) have identical longitudinal lengths, and operated synchronously.

The endless belt-shaped printing plate 13*a* wound about the plate cylinder 23 of the first printer 18 is equipped with, for example a pair of inking rollers 25*a*, to which a printing ink of predetermined color, such as black, blue or green, is supplied. The supplied printing ink is applied to the plate surface of the endless belt-shaped printing plate 13*a*. The printing ink applied to the plate side of the printing plate 13*a* is transferred for printing to the continuous web form 12 supplied from the feed roll 11. The continuous web form 12 is pressed by an impression cylinder 26, and the image on the endless belt-shaped printing plate 13*a* is printed to the continuous web form 12 by the pressure.

In the first printer 18, note faces (page faces) of unit forms 12*a*, 12*b*, . . . , as shown in FIG. 2, are formed by printing on the front surface or back surface of the continuous web form 12. Necessary information or a required data description column is formed on the note face of each unit form 12*a*, 12*b*, . . . .

More specifically, in case of using the notebook manufacturing apparatus 10 for manufacturing a notebook for use as a research-and-development note or a technical development note, each note face may be provided with a main data area 27 for indicating a progress of research or technical development, a study subject, contents of various actions, a memo, etc., and also a date column 28 for indicating year, month and day of record, an attestation (or acknowledgement) column 29 for superiors, a name column 30 for indicating the name of a person in charge and a participant, etc.

The main data area 27 includes horizontal ruled lines 31 and vertical ruled lines 32 to form a note area, wherein successive row numbers are attached to rows between successive horizontal ruled lines 31, and successive page numbers are allotted to an upper corner or a lower end center of the respective note faces (page faces) of consecutive unit forms 12*a*, 12*b*, . . . , of the continuous web form 12. Each horizontal ruled line 31, except for the lowermost one, may be formed as a horizontal ruled line formed of a succession of relatively fine micro characters of 0.3P (point)-0.7P (point). Some example of the horizontal ruled line 31 is described later.

After the page faces (note faces) of the unit forms 12*a*, 12*b*, . . . , are consecutively printed on one surface (form surface) of the continuous web form 12, the continuous web form 12 is guided to a second printer 19, where watermarks 33 of the shape of, e.g., a cherry petal, are printed on the respective note faces (page faces) of the unit forms 12*a*, 12*b*, . . . , of the continuous web form 12 by inking rollers 25*b* and an endless belt-shaped printing plate 13*b* of the second printer 19. Such watermarks 33 may be attached in order to express a looking of high-class printing and may also be given as other shapes than petals, or a mark or name of a company, etc.

After the page faces (note faces) of the unit forms 12*a*, 12*b*, . . . , are printed by the first printer 18 and the watermarks 33 are printed on the note faces by the second printer 19 at a note face, the continuous web form 12 is sent to the form inverter (or turnover) device 20 where the back and front surfaces of the continuous web form 12 are reversed.

Figure 3:
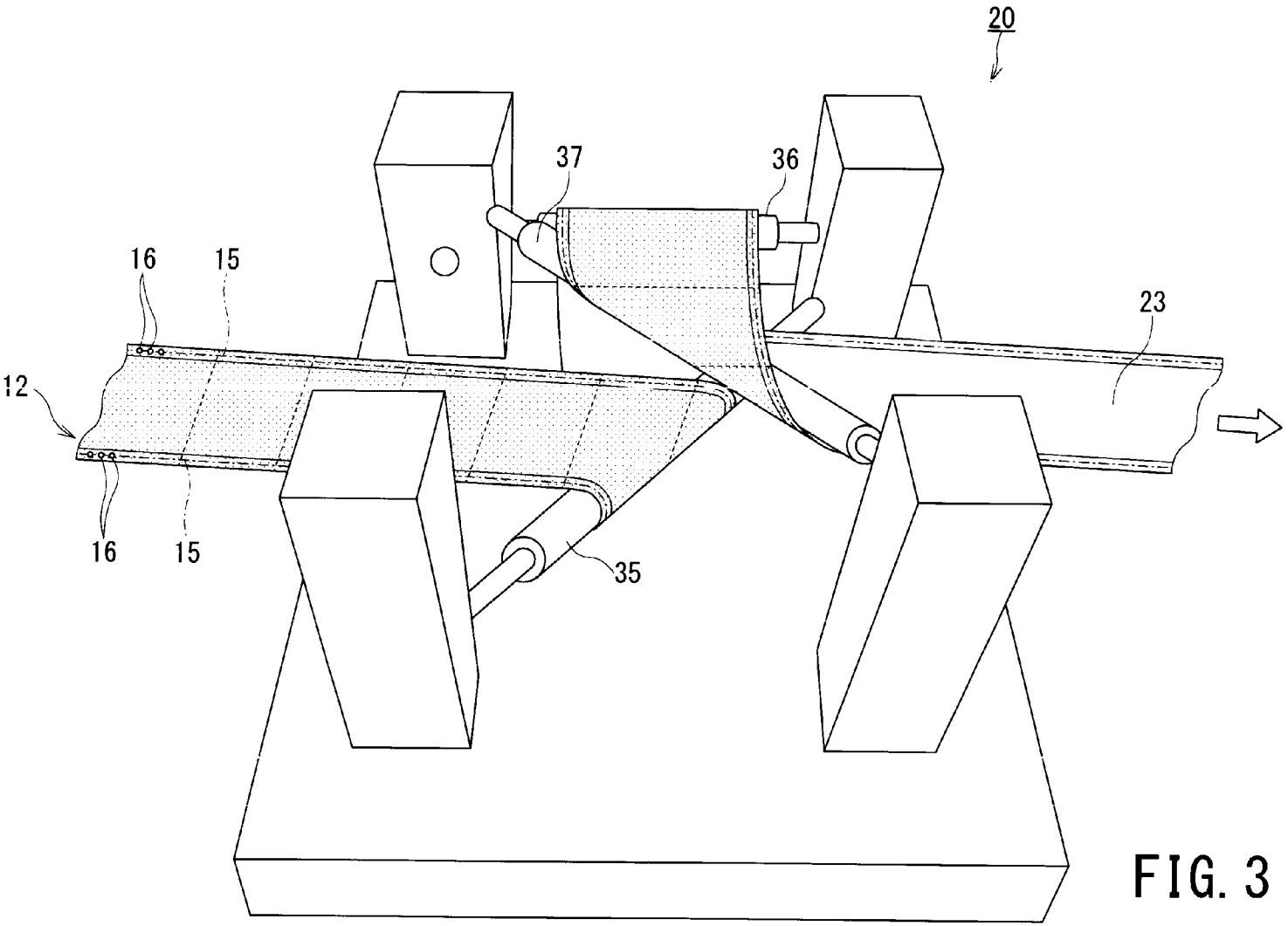
FIG. 3 is a perspective view showing a form inverter device installed at an intermediate position in the above-mentioned apparatus.

The form inverter 20 may be composed as shown in FIG. 3, and the continuous web form 12 conveyed thereto is guided to a lower guide bar 35 inclined 45 degrees to the run direction so that the non-printed (e.g., front) surface of the web form 12 contacts the bar 35, further guided toward a lateral side and then inverted upside down by a rotatably disposed guide bar 36. At the guide bar 35, the web form 12 is guided upwards and then turned over. The reversed continuous web form 12 is led to an upper guide bar 37, where its run direction is changed so as to intersect perpendicularly with the previous one. The upper guide bar 37 crosses so as to intersect perpendicularly to the downward guide bar 35 as viewed in plane, and the continuous web form 12 is further turned upside down to be guide to a third printer 21.

In the third printer 21, printing is continuously performed to the front (or back) surface of the continuous web form 12 similarly as in the first and the second printers 18 and 19 using an endless belt-shaped printing plate 13*c* and the inking rollers 25*c*. In a specific example, by the third printer 21, the same printing as the first printer 13 is performed to the front (or back) surface of the continuous web form 12. Therefore, a series of printings can be continuously performed to the front and back surfaces of the continuous web form 12 by the first printer 18 and the third printer 21.

After the printing on both surfaces is performed, the continuous web form 12 is led to the inspection device 40, where the continuous web form 12 is inspected with respect to a positional deviation, printing unevenness, etc. The inspected continuous web form 12 is then guided to a cutting machine 41, where marginal zones 15 of the continuous web form 12 are cut off along slitter lines 15*a* (FIG. 2). It is also possible that the cutting-off of the marginal zones 15 of the continuous web form 12 with the cutting machine 41 is omitted, in case where the continuous web form 12 after the inspection needs to be processed by a computer etc. In this case, the continuous web form 12 may be caused to bypass the cutting machine 41 and be directly sent to the zigzag folding apparatus 44.

As the zigzag folding apparatus 44, a zigzag folding apparatus equipped with a fold line generator as disclosed in JP5324950B (incorporated herein by reference) may be used for example. According to such a zigzag folding apparatus, the continuous web form 12 is alternately provided with a ridge-like projection line or a valley-like depression line (each functioning as a fold line) in transverse directions for every unit form 12*a*, 12*b*, . . . . The zigzag folding apparatus 44 is equipped with such a fold line generator and a press for fixing the resultant fold lines, so that the continuous web form 12 is provided with a zigzag-folded state for every unit form 12*a*, 12*b* - - - .

Moreover, the continuous web form 12 has been printed on both surfaces thereof by the first to the third printers 18, 19 and 21, so that there is provided with a continuous web form including consecutive unit forms printed on both surfaces and zigzag-folded with alternate ridge-like projection lines and valley-like depression lines extending in transverse directions. Thus, by the zigzag folding apparatus 44, the continuous web form 12 is zigzag-folded for every unit form 12*a*, 12*b*, . . . , and is successively conveyed to and piled up on a stacker 45.

The continuous web form 12 folded up in a zigzag shape on the stacker 45 is caused to form a group 46 of preset number, e.g., 50 or more, of unit forms 12*a*, 12*b*, . . . , and one volume of notebook may be obtained by cutting off such a unit form group in the transverse direction and separating it from the remainder of the continuous web form 12. If desired, such a continuation of zigzag-folded continuous web form 12 may be provided with plural volumes, e.g. two volumes of printed notebook data to form two groups 46 of unit forms, which are then cut in separation for each group to provide plural volumes of notebook.

[Notebook]

Figure 4:
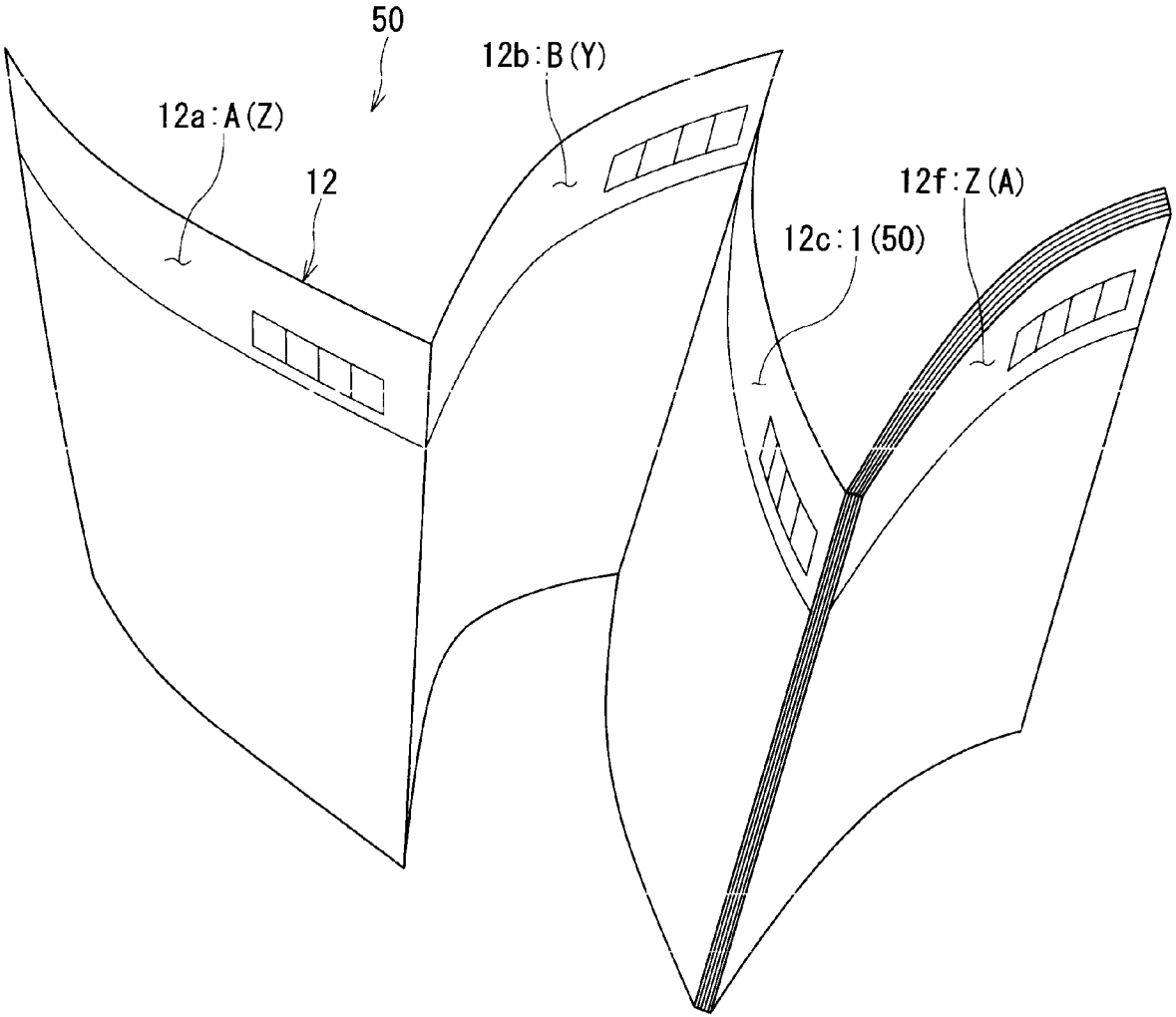
FIG. 4 is a perspective view illustrating an example of notebook produced by the above-mentioned apparatus.

An example of notebook 50 consisting of a zigzag-folded unit form group 46 is shown in FIG. 4. The notebook 50 consists of a unit form group comprising 54 sheets of unit forms which has been cut out from a zigzag-folded the continuous web form 12 and piled up. The unit form group constituting the notebook 50 in this example has 54 note faces (page faces) including sequentially a unit form A, a unit form B, a unit form 1, - - - , a unit form 50 and a unit form Y, and a unit form Z on a front surface (one surface) of the continuous web form 12. Also on the back (on the other surface) of the continuous web form 12, a unit form Z, a unit form Y, a unit form 50, - - - , a unit form 1, a unit form B and a unit form A are sequentially formed corresponding to the front surface.

The notebook 50 consisting of the unit form group 46 may be formed of unit forms of A4 size or B5 size, for example, and the first unit form A on the front surface side may constitute a front cover page, and the last unit form Z on the front surface side may constitute a back cover. The second unit form B on the front surface side can form a printed contents page for example. Accordingly, one notebook 50 consisting of a single unit form group 46 may include at least 50 inner paper sheets giving at least 50 pages of unit form 1, unit form 2, - - - , unit form 50 on each of the front and back surface sides and totally at least 100 pages on both surface sides. It is also possible that one zigzag-folded notebook including a plurality of unit form groups without separation constitutes a notebook having plural times of volume as that of a notebook 50 comprising a single unit form group.

Anyway, the zigzag-folded notebook 50 allows spread-reading of reading and checking data described on the notebook in a spread state and therefore in a wider area, thus giving a better scrutinizing efficiency.

By the way, a notebook 50 of a unit form group can be modified by bonding a thick paper for a cover onto each of unit form A and unit form Z on the front surface side of the continuous web form 12 to provide a zigzag-folded notebook with a front and back cover pages. Such a zigzag-folded notebook of so-called "houchouori" is suitable for spread-reading of a supra, the Bible, a long speech manuscript, etc.

Figure 5:
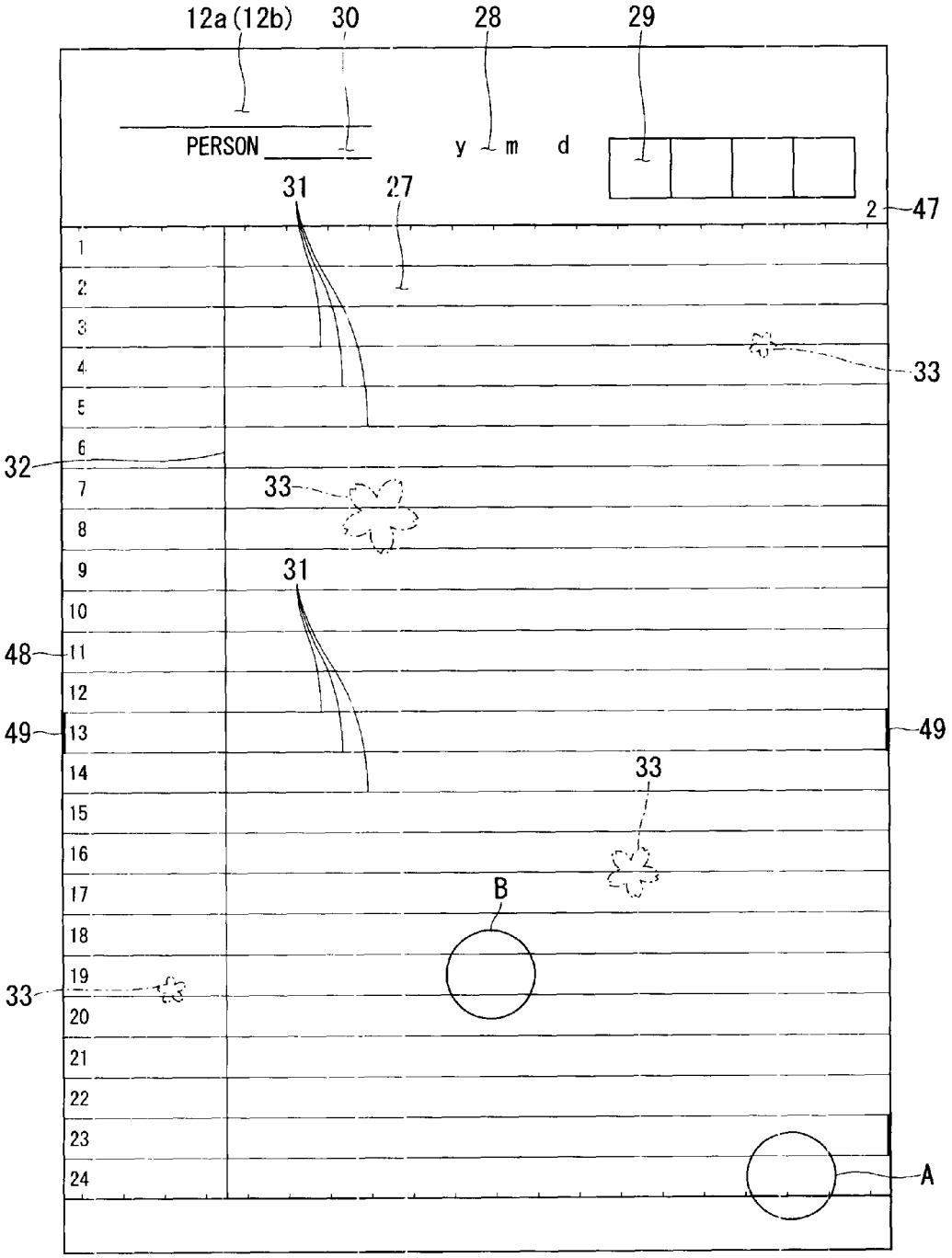
FIG. 5 is a plan view showing a note face of unit form constituting the above-mentioned notebook.

Moreover, in one notebook or a plurality of notebooks, each of unit forms 12*a*, 12*b*, . . . connected in succession in a zigzag-folded state for constituting a notebook 50 may have a note face made up as shown in FIG. 5. More specifically, a unit form 12*a* may have a note face including a main data area 27, a date column 28, an attestation column 29, a name column 30, a successive page number 47, successive row numbers 48, an index column 49, and further an optional description column (not shown).

The index columns 49 are provided, e.g. as solid printed images at side edges of unit forms 12*a*, 12*b*, . . . , and a common index is given to an identical row of a group of e.g. 10 successive unit forms, such as unit form 1 to unit form 10, unit form 11 to unit form 20, unit form 21 to unit form 30, unit form 31 to unit form 40, or unit form 41 to unit form 50.

Moreover, the indexes 49 may alternatively be given as outlined characters in a colored background instead of printed solid images at side edges of unit form 1-unit form 50. Examples of such outlined characters may for example include names of administrative units, such as states, or names of tourist sites in administrative units on respective unit forms 1 to 50. In that case, supplemental indications regarding the administration unit names or tourist site names, such as names of broader administrative units or country name, may be given as solid printed images on e.g. unit forms 48 to 50. In this case, the row number of the index may be subtracted by a number of corresponding pages. As result, the breakage or omission of any unit forms can be easily found by observation of the index columns.

By the way, the main data area 27 of the unit forms 12*a*, 12*b*, . . . , may for example be formed by a multiplicity (e.g. 25) of horizontal ruled lines 31 and a vertical ruled line 32, for example. Among these, the horizontal ruled lines 31 for example may be formed of a succession of relatively fine micro characters. In an example, the uppermost and lowermost horizontal ruled lines among the horizontal ruled lines 31 may be formed of micro characters of 0.7P (point)-1.0P (point), and the remaining horizontal ruled lines 31 may be formed of finer micro characters of 0.3P-0.6P. Fine micro characters forming the horizontal ruled line 31 are difficult to recognize the contents thereof with naked eyes. In case of being copied with an electro-photo graphic copying machine, the micro characters forming the horizontal ruled lines 31 will be collapsed, and reproduction of the characters is impossible, thus preventing falsification to realize a high security.

Figure 6A:
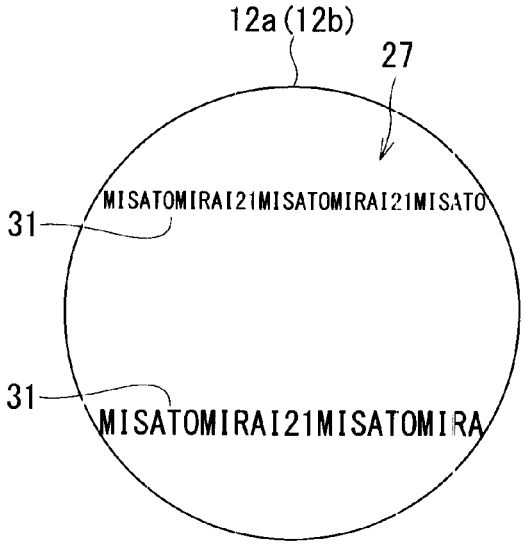
FIGS. 6A and 6B are partial views showing enlarged views of an A section and a B section on FIG. 5.
Figure 6B:
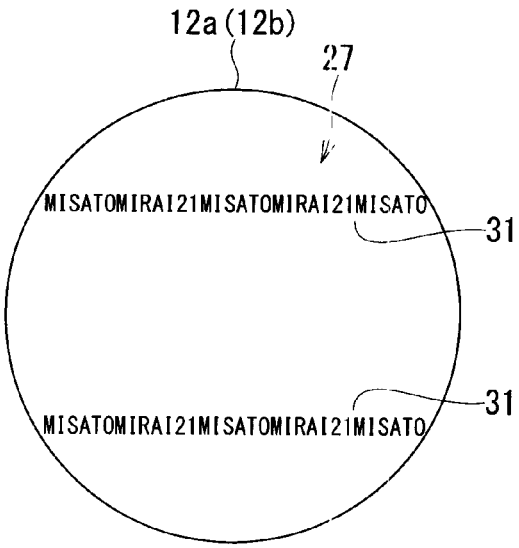

Moreover, the lowermost horizontal ruled line 31 may be formed of micro characters, of which the sizes are gradually enlarged from an intermediate point toward the end-of-the-line. It is also possible that the end of the lowermost horizontal ruled line 31 are formed of characters of e.g. 3P (size of about 1 mm), which can be recognized by naked eyes. FIG. 6A shows an enlarged view of a part A (a terminal point of the lowermost line 31) in FIG. 5, and FIG. 6B shows an enlarged view of a Part B (an intermediate point of the remaining horizontal ruled lines 31) in FIG. 5 at which the contents of micro characters can be recognized only after enlargement through a magnifying glass. As shown in FIGS. 6A and 6B, the micro characters forming the horizontal ruled lines 31 represent a corporate logo of the applicant company "MISATO MIRAI 21" as an example of successive micro characters forming a ruled line. Thus, the horizontal ruled lines 31 printed in the main data area 27 of the unit forms 12*a*, 12*b*, . . . , in this embodiment are not mere ruled lines but those formed of micro characters which imparts an identification function to the ruled line itself.

Moreover, the lowermost horizontal ruled line 31 may also be formed as a horizontal ruled line of characters of which the sizes are decreased from the starting end to an intermediate point. Anyway, it is desirable from a discernment function that the lowermost horizontal ruled line 31 in the main data area 27 is formed of characters, a part of which is enlarged in size.

Alternatively, it is also possible that the uppermost and lowermost horizontal ruled lines 31 of micro characters of identical sizes as the other horizontal ruled lines.

In the above, there has been described an embodiment of using endless belt-shaped printing plates 13 (13*a*, 13*c*) of the first printer 18 and the third printer 21 for printing on back (or front) surface and front (or back) surface, respectively, of the continuous web form 12, zigzag-folding up the thus-printed continuous web form 12 by a zigzag-folder 44 to form a group of a preset number of successive unit forms 46, and cutting the continuous web form 12 for every one or plural groups of successive unit forms to produce a notebook 50 comprising one or plural groups of zigzag-folded unit forms.

In the above-described embodiment, the front and back surfaces of the continuous web form 12 may be printed with inks of identical colors or different colors. However, it is impossible to change the color of ink for printing the respective unit forms 12*a*, 12*b*, . . . on the back (or front) surface of the continuous web form 12 from an intermediate point, or perform a multi-color printing. It is however possible to change the color of ink for printing on the back (or front) surface of the continuous web form 12 from an intermediate point, or perform a multi-color printing, if a number of printers corresponding to a number of ink colors required for printing on one (i.e. front or back) surface of the continuous web form 12 are used and they are operated according to an appropriate schedule of operation.

Second Embodiment

A second embodiment of the present invention will be described with reference to FIG. 7 to FIG. 10.

Figure 7:
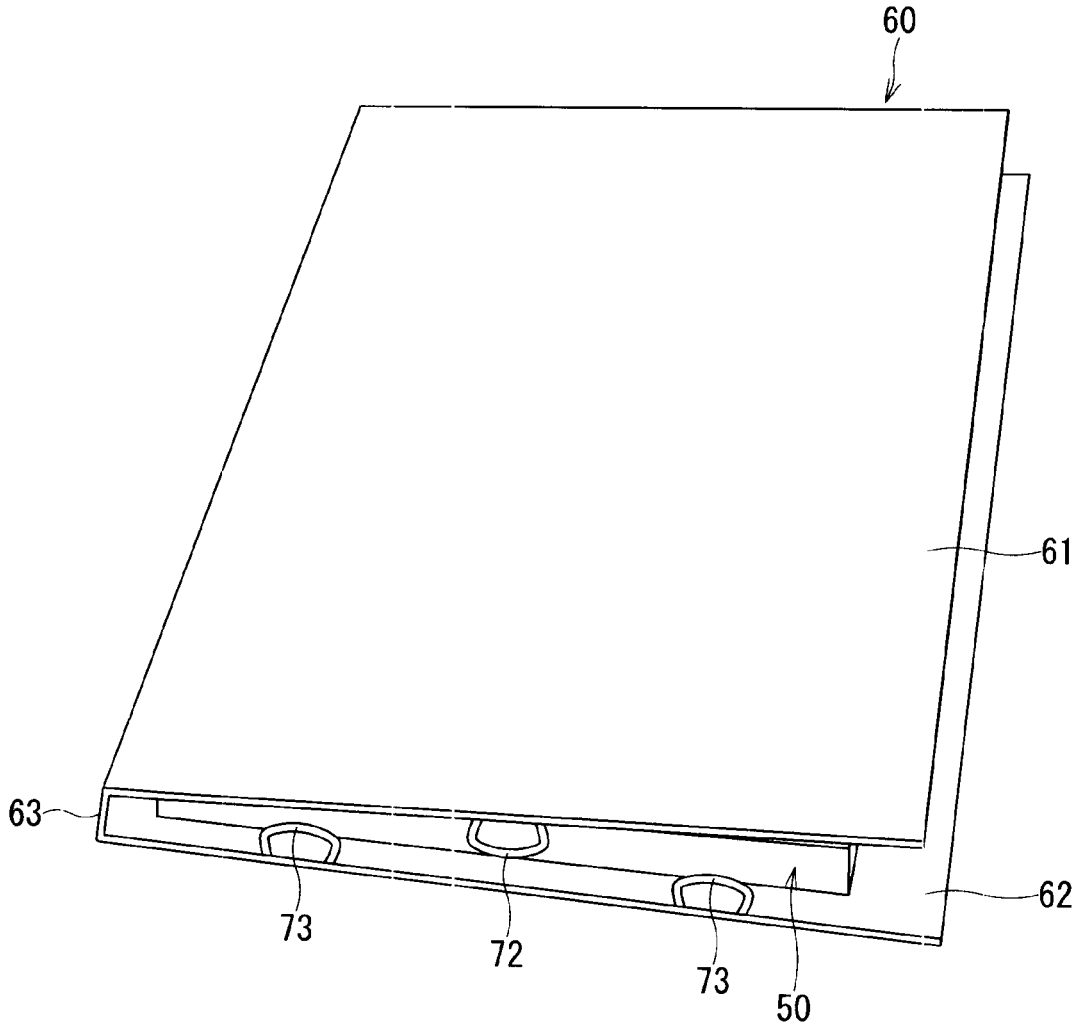
FIG. 7 illustrates a book cover for storing the notebook.
Figure 8:
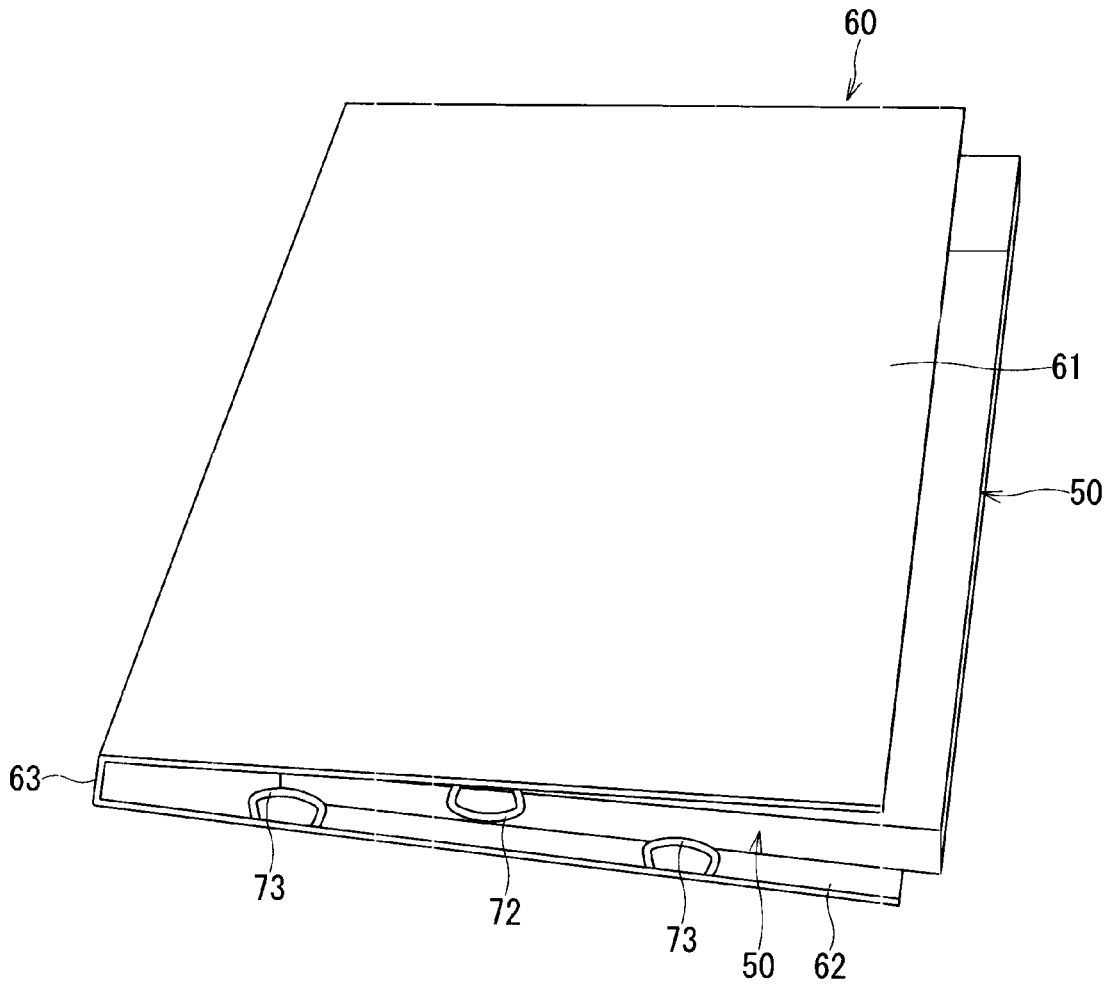
FIG. 8 illustrates a state of a notebook stored in the book cover.

The second embodiment is obtained by covering a notebook 50 produced by the notebook manufacturing apparatus 10 according to the above-mentioned first embodiment with a book cover 60. The book cover 60 is formed as a makeup cover made of a resin, a skin, a pasteboard, a wood, etc., as shown in FIG. 7 and FIG. 8. The book cover 60 may be prepared by bend and fold-up a sheet material into a succession of a front cover 61, a spine 63 and a back cover 62 which are closable and spreadable for reading the contents. On the face of the front cover 61 of the book cover 60, a column for inserting a title and an owner's name of the notebook (FIGS. 7 and 8), if needed.

Figure 9:
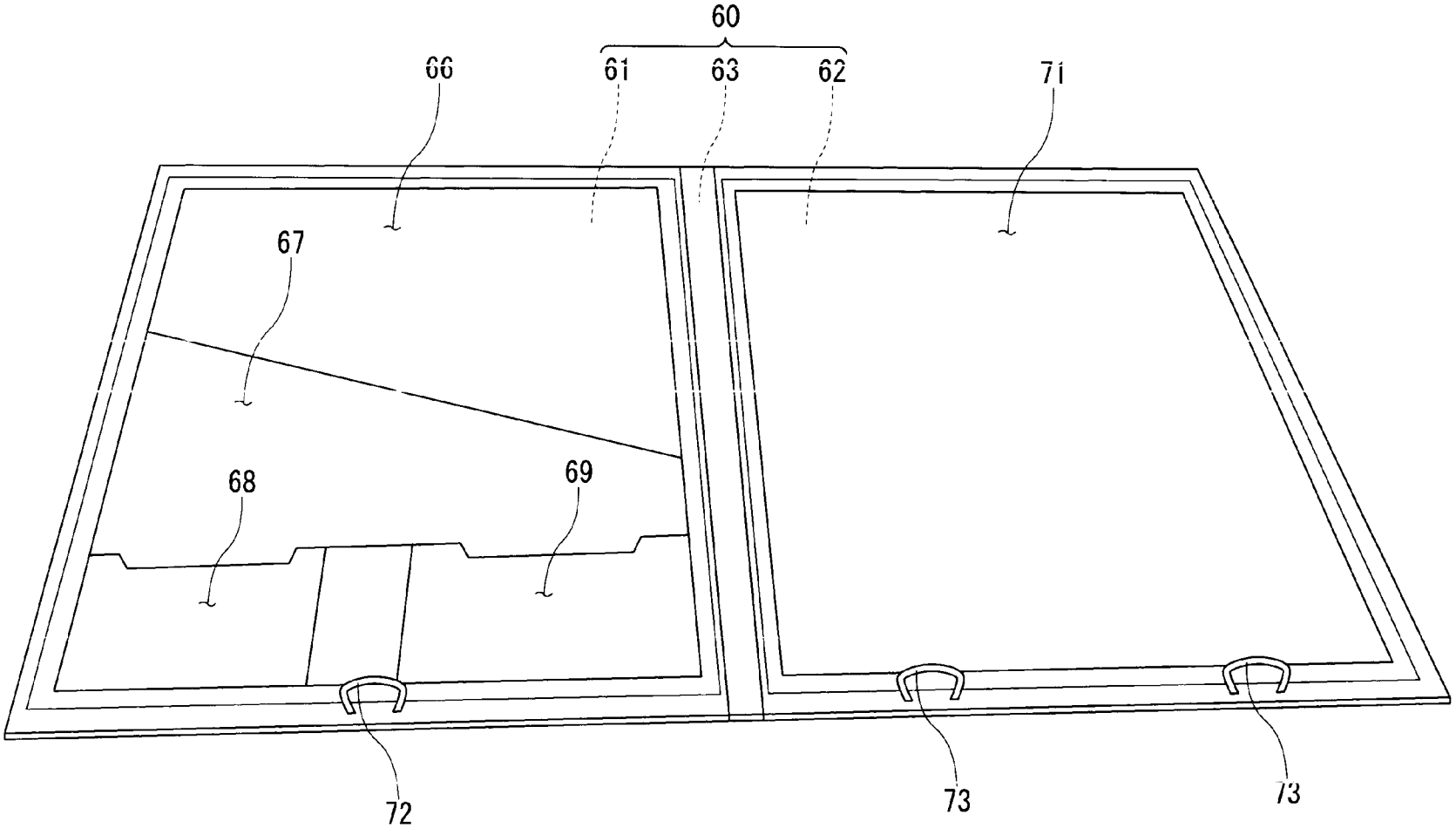
FIG. 9 illustrates a spread state of the book cover.
Figure 10:
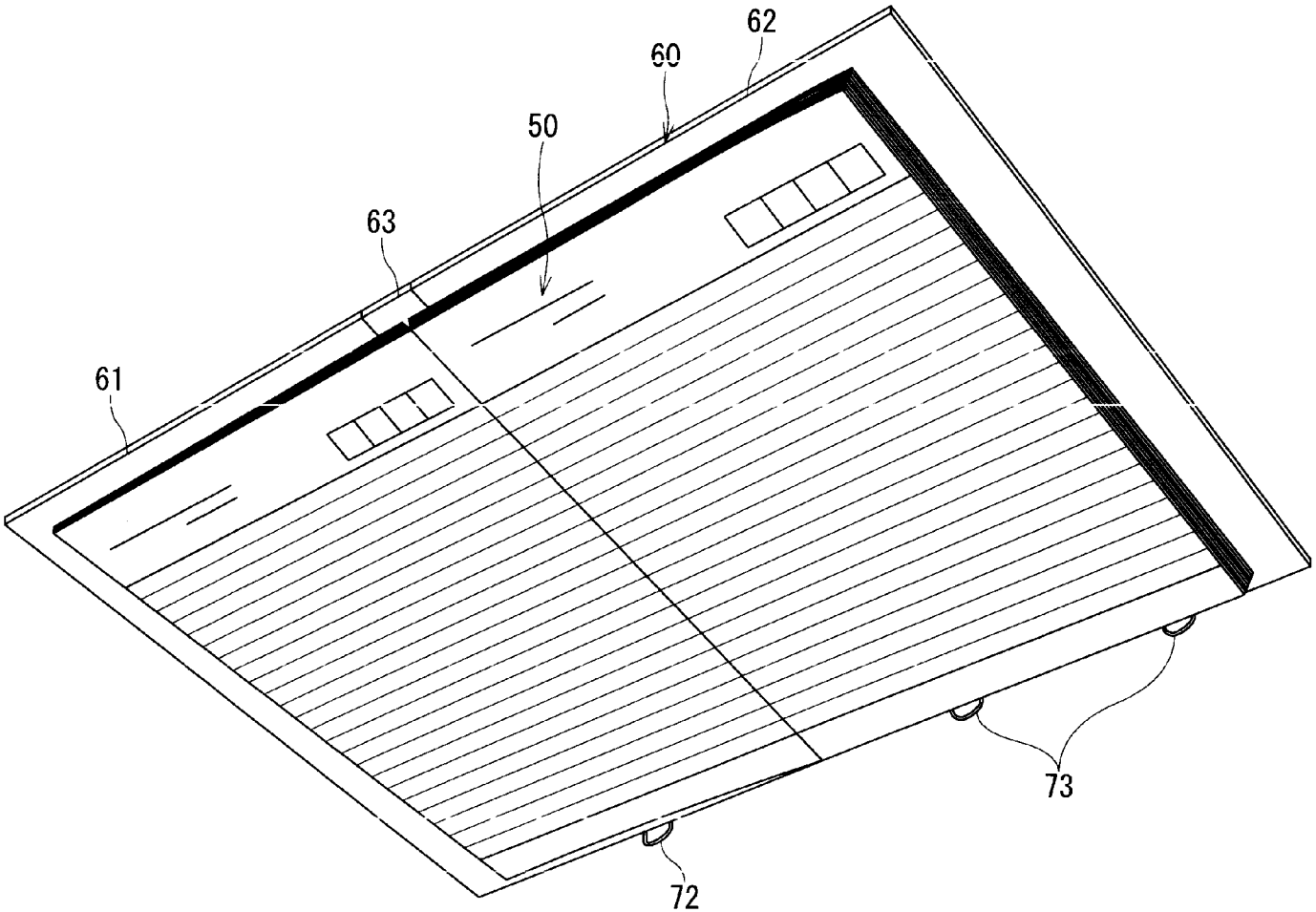
FIG. 10 illustrates a spread state of a notebook held in the book cover.

Moreover, as shown in FIG. 9 illustrating where the book cover 60 in a spread and opened state, a cover plate 61, of e.g. a plastic sheet, is applied or fixed along three peripheral sides on the back of the front cover 61 except for the boundary (an inner open side) with the back of the spine 63. The cover plate 66 on the back of the front cover 61 is equipped with a pocket 67 for inserting and holding separate paper sheets and the like and, at lower parts thereof, is further equipped with a holder pocket 67 for holding name cards, etc. and a holder pocket 68 for holding cards and the like.

Furthermore, in the spread state of the book cover 60 (as shown in FIG. 9), a portion of the unit forms constituting the notebook 50 is inserted from the opening (inner side opening) on the boundary with the back of the spine 63 of the cover plate 66 and held therein. More specifically, the unit form A and the unit form B on the front surface side of the notebook 50 are folded together and inserted from the inner side opening of the cover plate 66 and held thereat. Moreover, a cover plate 71 is applied like the cover plate 66 to the back of the back cover 62 of the book cover 60, and the unit form Y and unit form Z on the front surface side of the notebook 50 are folded together and inserted from an inner side opening of the cover plate 71, and held thereat. As a result, the notebook 50 is wholly covered, stored and protected with the book cover 60.

When the book cover 60 storing the notebook 50 is conveyed or spread open, as the notebook 50 is not in a form of booklet prepared by firm binding but has been prepared by zigzag folding-up, the inside papers forming folded unit forms of the notebook 50 can be freely spread and not constrained about intermediate spreading or falling. In this second embodiment, in order to hold the notebook 50 stably in the book cover 60, stoppers 72 and 73 are provided on the base sides of the front cover 61 and the back cover 62, so that non-intentional spreading or falling of intermediate unit forms of the notebook 50 is prevented. The stoppers 72 and 73 may be disposed at at least one part on the base sides of the front cover 61 and the back cover 62, respectively.

Although an embodiment of disposing stoppers 72 and 73 on the base sides of the book cover 60 is explained above, the stoppers 72 and 73 can also be disposed on both top and base sides.

Other Embodiments

In the above, embodiments of the present invention suitable for using a notebook 50 as a research-and-development note or a technical development note have been mainly described, but such a notebook 50 is also utilizable for use as a risk management note or an information control note.

An example of such a risk management has been proposed to have a note face of each unit form including columns for fill in necessary data for personal arrangement or self-control, such as various assets, liabilities, illness, and care, information for the life of every day, etc. Details of contents therein may be available in, e.g., "moshimo note" (roughly meaning a provident note)", written by Michiko Susai, published from Life and Ending Center (a non-profit organization) (2004).

Moreover, as an example of an information control note, it may be possible to refer to "EVER NOTE", written by Shinya Kita, published from K.K. Gijutsu Hyouron-sha (2011), which has proposed a note face of each unit form including an information arrangement column for collecting information of concern, an information processing column, an information check column, an information application column, etc.

Furthermore, while there has been described an embodiment wherein a notebook manufacturing apparatus is used to successively produce one or plural group(s) of unit forms successively from a continuous web form, it is also possible to use a type of notebook manufacturing apparatus using a wide endless belt-shaped printing plate for printing on a continuous web form having a large width to produce plural (e.g. two) groups of unit forms in parallel.

Moreover, in the above-described first embodiment, there has been described an embodiment wherein, in the printing on both surfaces of a continuous web form by using a first printer 18 and a third printer 21 (i.e., except for a second printer 19 for printing watermarks), an essentially identical pattern of printing (except for a possible change in order of printing on unit forms) is performed on both surfaces. It is however not essential that the contents of printing on both surfaces of the continuous web form performed using the first printer 18 and the third printer 21 are identical. Particularly, it is possible to restrict the printing of ruled lines formed of a succession of micro characters to only one of both surfaces and perform a simple printing, such as printing of only management data and without including micro characters, on the other surface.

NUMERALS IN THE DRAWINGS

10: notebook manufacturing apparatus, 11: feed roll; 12: continuous web form, 13: endless belt-shaped printing plate, 15: marginal zone (15*a*: slit line), 16: punched hole, 18: first printer, 19: second printer, 20: form inverter, 21: third printer 23: plate cylinder, 24: guide cylinder (guide roller), 25: inking roller, 26: impression cylinder, 27: main description area, 28: date column, 31: horizontal ruled line, 32: vertical ruled line, 33: watermark, 35: lower Guide bar, 36: guide roller, 37: upper guide bar, 40: inspection device, 41: cutter, 44: zigzag folding device, 45: stacker, 46: unit form group, 47: successive page number, 48: successive row number, 49: index column,

50: notebook, 60: book cover, 61: front cover, 62: back cover, 63: spine, 66, 71: cover plate, 67: support pocket, 68, 69: holder pocket, 72, 73: stopper.

The invention claimed is:

1. A notebook, comprising:

a unit form group including a preset number of consecutive unit forms zigzag-folded and printed on both faces thereof, said unit form group having been prepared by providing a continuous web form which has been printed on both surfaces thereof including at least one surface on which the unit forms are printed, folding up zigzag the continuous web form for every unit form, cutting the continuous web form for every preset number of consecutive unit forms, and stacking the unit forms to prepare a notebook, so as to allow spread-reading of the respective unit forms, wherein each unit form has a note face, the note face including a main data area having a plurality of printed ruled lines, a date region, and at least one succession of micro characters printed in the main data area, wherein each of the micro characters is one of a character, a numeral or a symbol of at most 1 point in size, and cannot be reproduced by an electro photographic copying machine, and wherein 1 point in size equals 0.3514 mm.

2. A notebook according to claim 1, wherein the printed ruled lines in the main data area include horizontal ruled lines, each formed of a corresponding succession of micro characters of the at least one succession of micro characters.

3. A notebook according to claim 2, wherein the printed ruled lines in the main data area include an uppermost horizontal ruled line and a lowermost horizontal ruled line, each formed of a corresponding succession of micro characters of the at least one succession of micro characters, of 0.7 to 1.0 point, and intermediate horizontal ruled lines, each formed of a corresponding succession of micro characters of the at least one succession of micro characters, of 0.3 to 0.7 point.

4. A notebook according to claim 2, wherein the printed ruled lines in the main data area include a lowermost horizontal ruled line formed of a corresponding succession of micro characters of the at least one succession of micro characters, of which print sizes thereof become gradually larger from an intermediate point of the lowermost horizontal ruled line toward an end of the lowermost horizontal ruled line, or become gradually smaller from a start of the lowermost horizontal ruled line toward the intermediate point of the lowermost horizontal ruled line.

5. A notebook according to claim 1, wherein the consecutive unit forms printed on one surface of the continuous web form have note faces printed with successive page numbers, respectively.

6. A notebook according to claim 1, wherein the consecutive unit forms printed on one surface of the continuous web form include a plurality fewer than the preset number of consecutive unit forms, have note faces printed with a common index.

7. A notebook according to claim 1, wherein the group of unit forms spreadably zigzag-folded and stacked of the notebook are covered spreadably with a book cover including a front cover, a spine and a back cover, and is disposed spreadably, wherein the front cover and the back cover are each provided with a cover plate applied onto a back thereof so as to allow insertion of a sheet behind the cover plate from an inward position of the cover plate, wherein a first unit form and a second unit form among the unit from group are held in a folded state by insertion between the back of the front cover and the cover plate, and wherein a last unit form and a last but one unit form among the unit from group are held in a folded state by insertion between the back of the back cover and the cover plate.

8. A notebook according to claim 7, wherein the front cover and the back cover are each provided with a stopper at a bottom on the back of each of the front cover and back covers, so as to prevent falling-off of intermediate unit forms among the group of unit forms out of the book cover.

9. A process for producing a notebook, comprising:

successively printing a multiplicity of unit forms including ruled lines each formed of a succession of micro characters by a first printer equipped with an endless belt-shaped printing plate on one surface of a continuous web form supplied from a feed roll, wherein each of the micro characters is one of a character, a numeral or a symbol of at most 1 point in size, and cannot be reproduced by an electro photographic copying machine, and wherein 1 point in size equals 0.3514 mm, inverting the front and back surfaces of the continuous web form with a form inverter, printing on the other surface of the continuous web form by a second printer equipped with an endless belt-shaped printing plate to provide the continuous web form with prints on both surfaces, folding up zigzag the continuous web form for every unit form to pile up the zigzag-folded continuous web form on a stack, and cutting and separating the continuous web form for every preset number of consecutive unit forms, thereby providing a notebook including a group of the preset number of consecutive unit forms which have been printed on both faces thereof and spreadably zigzag-folded.

10. A process according to claim 9, wherein the other surface of the continuous web form is also printed with a multiplicity of unit forms including ruled lines each formed of the succession of micro characters.

11. A process according to claim 9, wherein one circumferential printing operation each of the endless belt-shaped printing plates of the first and second printers, provides a plurality of notebooks each including a group of the preset number of consecutive unit forms.

12. A process according to claim 9, wherein each unit form is printed with a main data area, a date region, and a successive page number, the succession of micro characters being printed as at least a portion of horizontal ruled lines in the main data area.

13. A process according to claim 9, wherein the first and second printers are aligned along a substantially straight feed path of the continuous web, and wherein the form inverter is disposed between the first and second printers and includes:

a first rotatable guide bar extending in a first direction oblique to the web feed path, a second rotatable guide bar extending parallel to the web feed path, and a third rotatable guide bar extending in a second direction which is oblique to the web feed path and orthogonal to the first direction, so that the continuous web printed on the front surface thereof by the first printer is sent along through the first to third guide bars while contacting the first to third guide bars with the non-printed back surface and inverting the front and back surfaces to be printed on the back surface by the second printer.

* * * * *